US009923296B2

(12) United States Patent
Mito

(10) Patent No.: US 9,923,296 B2
(45) Date of Patent: Mar. 20, 2018

(54) ELECTRIC CONNECTOR TERMINAL SECURED IN A CONNECTOR HOUSING AND ELECTRIC CONNECTOR

(71) Applicant: Tyco Electronics Japan G.K., Kanagawa (JP)

(72) Inventor: Yusuke Mito, Kanagawa (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 15/064,912

(22) Filed: Mar. 9, 2016

(65) Prior Publication Data

US 2016/0190724 A1 Jun. 30, 2016

Related U.S. Application Data

(63) Continuation of application No. PCT/JP2014/073708, filed on Sep. 8, 2014.

(30) Foreign Application Priority Data

Sep. 9, 2013 (JP) ..... 2013-186389

(51) Int. Cl.
*H01R 13/422* (2006.01)
*H01R 13/432* (2006.01)
(Continued)

(52) U.S. Cl.
CPC ..... *H01R 13/432* (2013.01); *H01R 13/03* (2013.01); *H01R 13/4223* (2013.01); *H01R 12/724* (2013.01)

(58) Field of Classification Search
CPC ... H01R 13/432; H01R 27/00; H01R 13/4223
(Continued)

(56) References Cited

U.S. PATENT DOCUMENTS 3,530,429 A * 9/1970 Scheller ..... H01R 13/04 439/746
4,114,975 A * 9/1978 Weidler ..... H01R 4/2437 439/395

(Continued)

FOREIGN PATENT DOCUMENTS

JP 5786275 11/1955
JP 496547 2/1974

(Continued)

OTHER PUBLICATIONS

PCT Notification of Transmittal of Translation of International Preliminary Report, Intl Application No. PCT/JP2014/073708, dated Mar. 24, 2016, 1 page.

(Continued)

*Primary Examiner* — Edwin A. Leon
*Assistant Examiner* — Paul Baillargeon
(74) *Attorney, Agent, or Firm* — Barley Snyder

(57) ABSTRACT

An electrical connector is provided and includes a housing and a terminal. The housing includes a terminal receiving passageway and a lance extending into the terminal receiving passageway. The terminal is inserted into the terminal receiving passageway and includes a top surface facing the lance and a holding portion extending from and above the top surface.

15 Claims, 5 Drawing Sheets

(51) Int. Cl.
*H01R 13/03* (2006.01)
*H01R 12/72* (2011.01)

(58) Field of Classification Search
USPC ..... 439/746, 872, 76.2, 76.1, 869, 870, 873, 439/874, 115, 119, 907, 752.5, 603, 751
See application file for complete search history.

(56) References Cited

U.S. PATENT DOCUMENTS

| | | | | |
|---|---|---|---|---|
| 5,102,356 | A | 4/1992 | Adams et al. | |
| 5,139,446 | A * | 8/1992 | Costello | H01R 13/42 439/751 |
| 5,286,218 | A * | 2/1994 | Sakurai | H01R 13/5045 439/444 |
| 5,658,168 | A | 8/1997 | Myer et al. | |
| 6,872,093 | B2 * | 3/2005 | Fukatsu | H01R 13/4362 439/595 |
| 7,347,699 | B2 * | 3/2008 | Sato | H01R 9/096 439/66 |
| 8,465,315 | B2 | 6/2013 | Matsumoto et al. | |
| 9,407,047 | B1 * | 8/2016 | McCauley | H01R 13/193 |
| 2004/0009685 | A1 | 1/2004 | Yamashita | |
| 2005/0277341 | A1 * | 12/2005 | Noguchi | H01R 13/41 439/884 |

FOREIGN PATENT DOCUMENTS

| | | |
|---|---|---|
| JP | 4942485 | 4/1974 |
| JP | 55144774 | 10/1980 |
| JP | 55170770 U | 12/1980 |
| JP | 56127681 U | 9/1981 |
| JP | 5756470 | 12/1982 |
| JP | 2011086478 A | 4/2011 |
| JP | 2011187412 A | 9/2011 |

OTHER PUBLICATIONS

PCT International Preliminary Report on Patentability, Intl Application No. PCT/JP2014/073708, dated Mar. 15, 2016, 8 pages.
Abstract of JP2011187412, dated Sep. 22, 2011, 2 pages.
International Search Report, Intl Application No. PCT/JP2014/073708, dated Oct. 7, 2014, 11 pages.
Japanese Office Action, dated May 3, 2017, 6 pages.
Abstract of JP2011086478, dated Apr. 28, 2011, 1 page.

* cited by examiner

ELECTRIC CONNECTOR TERMINAL SECURED IN A CONNECTOR HOUSING AND ELECTRIC CONNECTOR

CROSS-REFERENCE TO RELATED APPLICATIONS

This application is a continuation of PCT International Application No. PCT/JP2014/073708 filed Sep. 8, 2014, which claims priority under 35 U.S.C. § 119 to Japanese Application no. 2013-186389 filed Sep. 9, 2013.

FIELD OF THE INVENTION

The invention relates to an electrical connector terminal and, in particular, to an electrical connector terminal secured in a connector housing.

BACKGROUND

There are known connector housings that include a lance to secure an electrical connector terminal to prevent it from falling there from.

Japanese patent application no. JP2011-86478A discloses a connector that is configured in such a way that when a terminal is inserted and secured into a terminal receiving section when a lance abuts the terminal to lock the terminal and the lance together. When a front end of the terminal is used in a board-mounting type connector to connect to a board, the terminal is secured to the board by soldering. Normally, solder wettability along the front end of the terminal is improved by applying metal plating, for example, tin plating. However, when the terminal is inserted into the terminal receiving section, the lance comes into contact with a surface of the terminal and the plating may peel off. If the peeling-off occurs, desired solder wettability cannot be obtained.

SUMMARY

The invention has been made in view of such a problem, and an object thereof is to provide an electrical connector that includes a housing and a terminal. The housing includes a terminal receiving passageway and a lance extending into the terminal receiving passageway. The terminal is inserted into the terminal receiving passageway and includes a top surface facing the lance and a holding portion extending from and above the top surface.

BRIEF DESCRIPTION OF THE DRAWINGS

The invention will now be described by way of example with reference to the accompanying figures, of which.

DETAILED DESCRIPTION OF THE EMBODIMENT(S)

The invention will be explained below in detail based upon embodiments shown in the accompanying figures.

Figure 1:
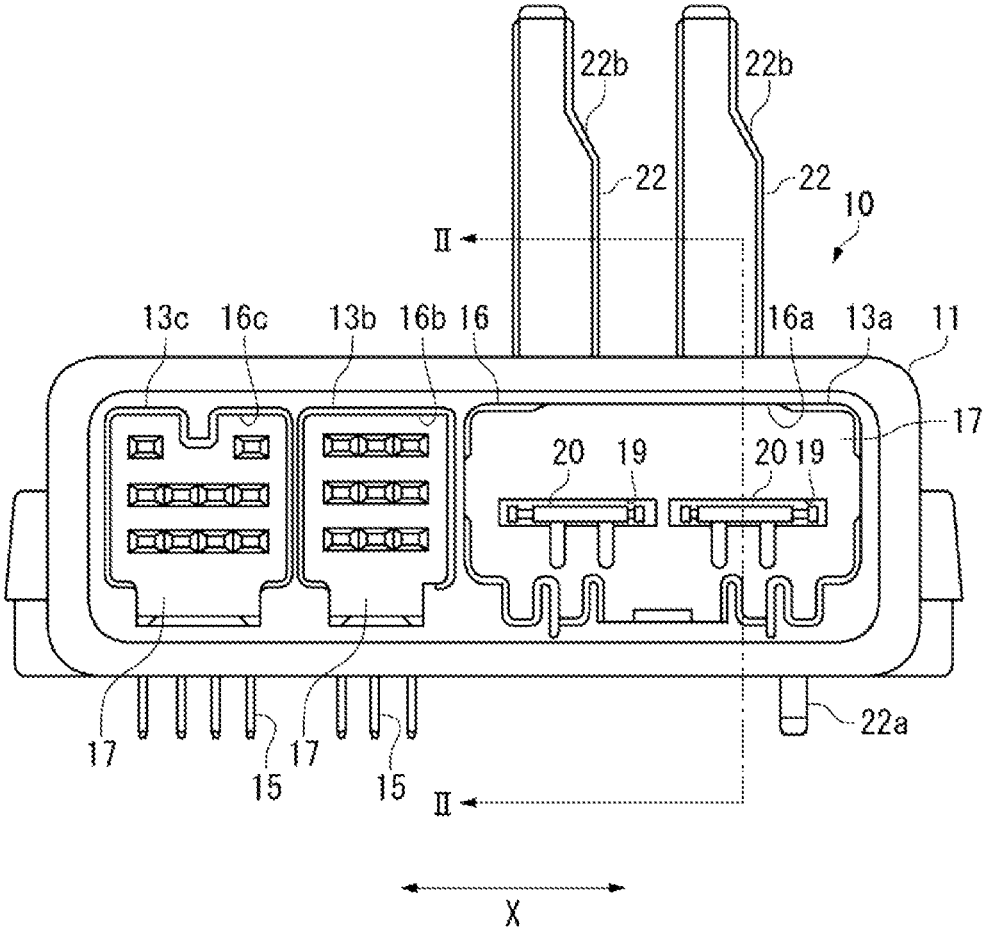
FIG. 1 is a front view of an electrical connector according to the invention.
Figure 2:
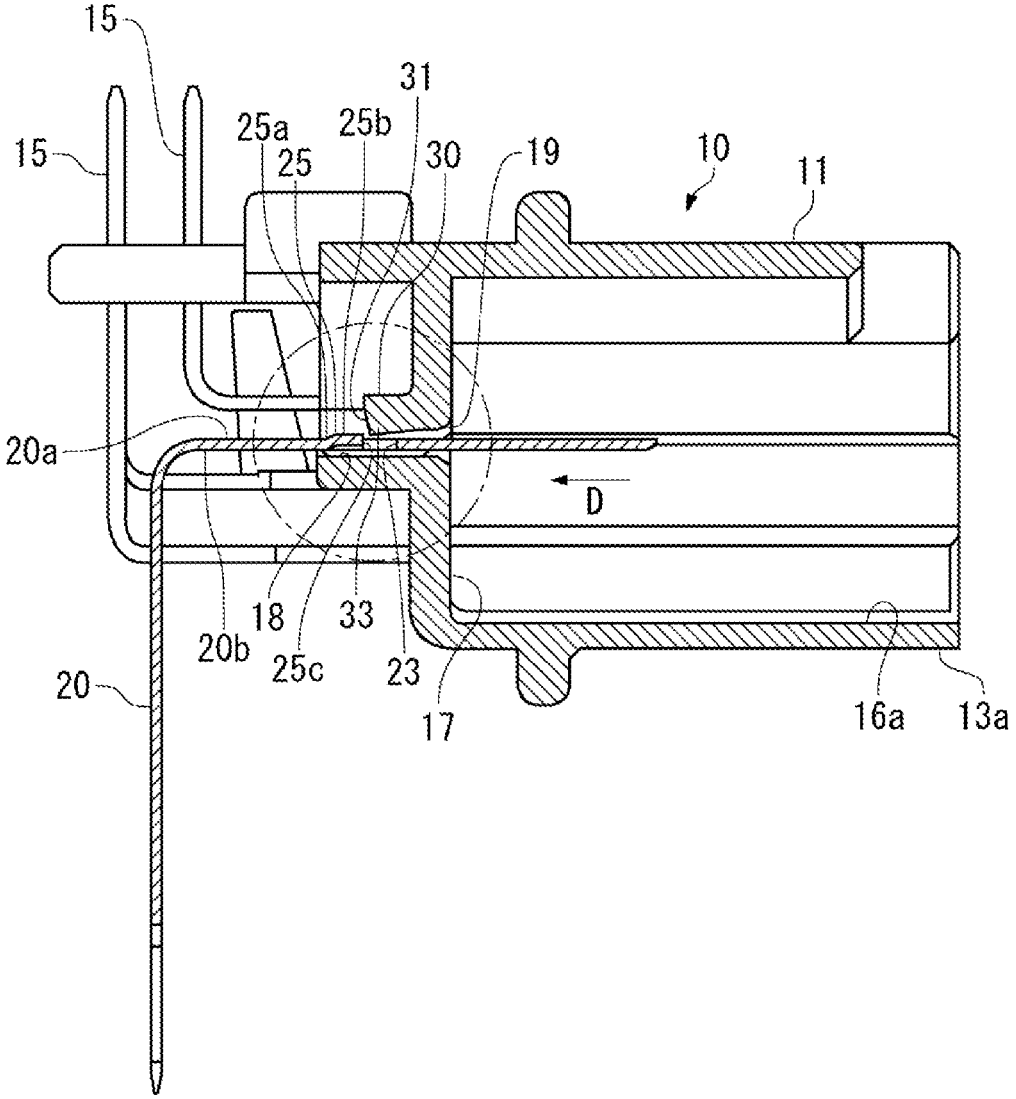
FIG. 2 is a sectional view of the electrical connector of FIG. 1 taken along line II-II.

First with reference to FIG. 1 and FIG. 2, a connector 10 includes with a plurality of tab terminals 20, a plurality of pin terminals 15, and a housing 11 configured to be mated with a mating connector (not shown). The housing 11 is designed to secure the terminals 20 and terminals 15 and, in particular the housing 11 includes a housing lance (hereinafter, simply called "lance") 30 to secure the terminals 20.

The housing 11 is manufactured by injection-molding an insulating resin.

The housing 11 includes with a mating connector receiving cover 13*a* configured to mate with a mating connector. A connector receiving space 16*a* is provided inside the mating connector receiving cover 13*a* and into which the mating connector is inserted from an opened front portion thereof. The connector receiving space 16 includes a rear portion sectioned by a depth wall 17. A plurality of terminal receiving passageways 19 (two holes are shown in FIG. 1) are provided in the connector receiving space 16*a* of the mating connector receiving cover 13*a* so as to penetrate the front and back of the depth wall 17.

The terminal receiving passageway 19 includes a lance 30 provided on an upper side thereof and a supporting wall 18 provided on a lower side thereof so as to face the lance 30. The lance 30 and the supporting wall 18 are both formed integrally with the depth wall 17, and project rearward.

The housing 11 is further provided with mating connector receiving covers 13*b* and 13*c*. For sake of brevity, description of the covers 13*b* and 13*c* is omitted.

The terminal 20 and the terminal 15 are held by press-fitting them into the housing 11, portions thereof are arranged inside the connector receiving space 16*a*, and the other portions thereof are arranged outside the housing 11. Incidentally, the terminal 20 is used for power supply, while the terminal 15 is used for signal transmission.

The terminal 20 electrically connects a board and a mating connector with each other.

Figure 3A:
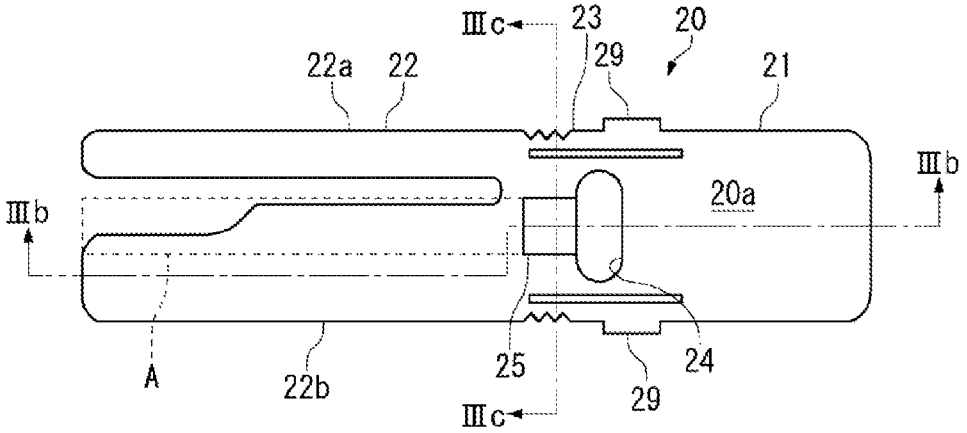
FIG. 3*a* is a plan view of a terminal of electrical connector according to the invention.
Figure 3B:
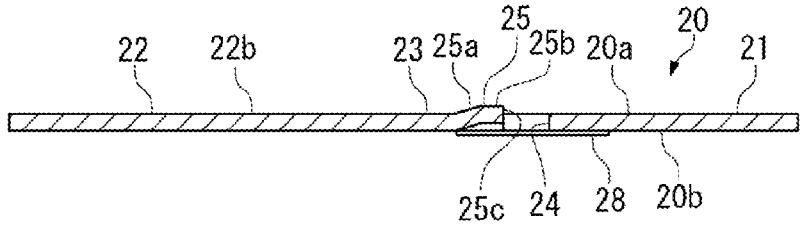
FIG. 3*b* is a section view of the terminal of FIG. 3*a* taken along line IIIb-IIIb.

As shown in FIG. 3(*a*), the terminal 20 includes with a connecting portion 21 provided for connection with a terminal of the mating connector, a tine portion 22 provided for connection with a board, and a holding portion 23 connecting the connecting portion 21 and the tine portion 22 with each other and provided so that the housing 11 secures the terminal 20.

The terminal 20 is integrally formed by stamping metal material excellent in electrical conductivity and elasticity, for example, a plate material made of copper alloy.

As shown in FIG. 3(*b*), the holding portion 23 includes a receiving passageway 24 penetrating the top and bottom thereof, and a lock 25 extending toward the receiving passageway 24 and the connecting portion 21. The receiving passageway 24 and the lock 25 are arranged at a central portion of the holding portion 23 along a widthwise direction X.

The lock 25 includes with an inclined portion 25*a*, a flat portion 25*b*, and a locking side 25*c*. The inclined portion 25*a* rises up from the top side 20*a* of the terminal 20, and toward the connecting portion 21. Further, the flat portion 25*b* communicates with the inclined portion 25*a* and is parallel to the top side 20*a*. The locking side 25*c* is formed so as to suspend from a front end of the flat portion 25*b* and is perpendicular to the top side 20*a*.

Incidentally, the lock 25 is formed by cutting and raising a portion of the terminal 20. The lock (locking portion) can be formed integrally with the terminal by formation performed by cutting and raising a portion of the terminal without adding a special step.

Further, as shown in FIG. 3(*c*), press-fitting projections 28 and 28 are formed on both sides of the holding portion 23 along a width thereof so as to sandwich the receiving passageway 24 and the lock 25. The press-fitting projections 28 and 28 project from a bottom side 20*b* of the terminal 20 in order to improve a retention force due to press-fitting of the terminal 20 into the housing 11 obtained by pressing of the press-fitting projections 28 and 28 against the supporting wall 18 with limited pressure, and they are formed by performing press forming.

In addition, tabs 29 and 29 are formed to project from both edges of the holding portion 23 along a width thereof. The tabs 29 and 29 are inserted into holding grooves (not shown) provided in the housing 11 to hold the terminal 20 at a predetermined position of the housing 11.

Figure 3C:
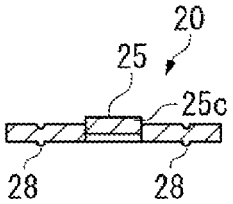
FIG. 3*c* is a section view of the terminal of FIG. 3*a* taken along line IIIc-IIIc.

In the shown embodiment, the tine portion 22 is bifurcated from its middle and includes a first tine 22*a* and a second tine 22*b*. The first tine 22*a* is folded to a lower side and is to be connected to a first board (not shown) arranged on a lower side of the connector 10. Further, the second tine 22*b* is folded to an upper side and is to be connected to a second board (not shown) arranged on an upper side of the connector 10. Incidentally, after the terminal 20 is assembled at the predetermined position of the housing 11 in a flat state shown in FIG. 3*c*, the first tine 22*a* and the second tine 22*b* are folded as shown in FIG. 1 and FIG. 3*c*.

Further, the first tine 22*a* and the second tine 22*b* are electrically connected and fixed to the first board and the second board by soldering process, respectively. In order to improve solder wettability, plating films made of the same metal as that of a main component (for example, tin) of the solder are applied to surfaces of the first tine 22*a* and the second tine 22*b*.

Here, the terminal 20 includes for power supply and the tine portion 22 (the first tine 22*a* and the second tine 22*b*) includes a width corresponding to current caused to flow in order to allow flow of large current in the tine portion 22. If the width is narrow, the temperature of the terminal 20 may rise abnormally.

In the shown embodiment, the lance 30 is a cantilever member which prevents the terminal 20 from falling out from the housing 11 unintentionally. The lance 30 extends to a rear end side to be locked to the terminal 20. The lance 30 is inclined in such a way so as to descend rearward.

The lance 30 comes in contact with a lock 25 of the terminal 20 to be pushed up in the process of inserting the terminal 20 to a predetermined position. When the lance 30 is inserted to a predetermined holding position, the pressing-up is released and a locking side 31 at a front end of the lance 30 and a locking side 25*c* of the terminal 20 face each other to be locked to each other, so that the terminal 20 is retained.

The lance 30 is set such that a lower end position 33 of the lance 30 is higher than a top side 20*a* of the terminal 20 described later and it is lower than a flat portion 25*b* of the lock 25 in a free state until the lance 30 comes in contact with the lock 25.

Incidentally, the lance 30 is made of insulating resin, and it is formed integrally with the housing 11.

Figure 4A:
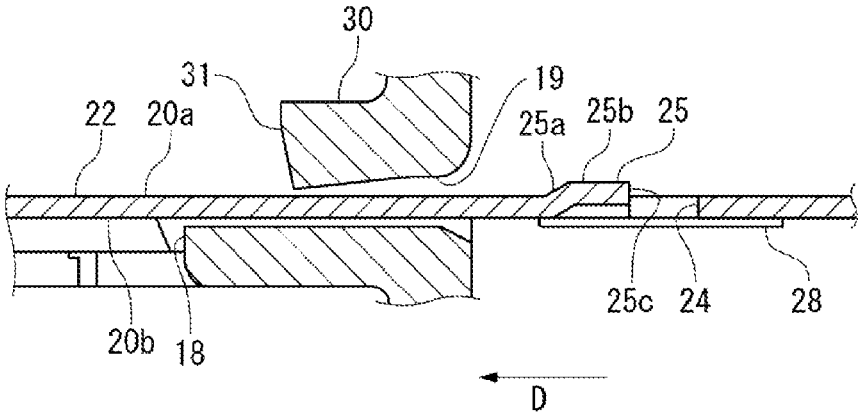
FIG. 4*a* is a sectional view of a terminal and a housing of the electrical connector according to the invention, showing insertion of the terminal into the housing.
Figure 4B:
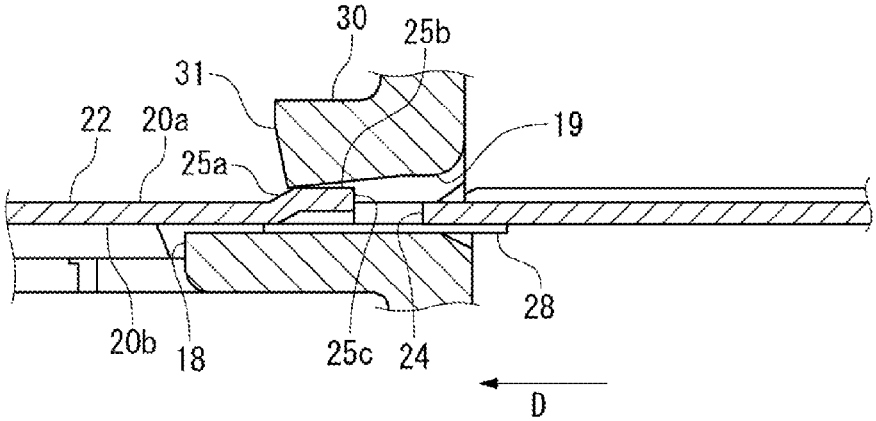
FIG. 4*b* is another sectional view of the terminal and the housing of FIG. 4*a*, showing further insertion of the terminal into the housing.
Figure 4C:
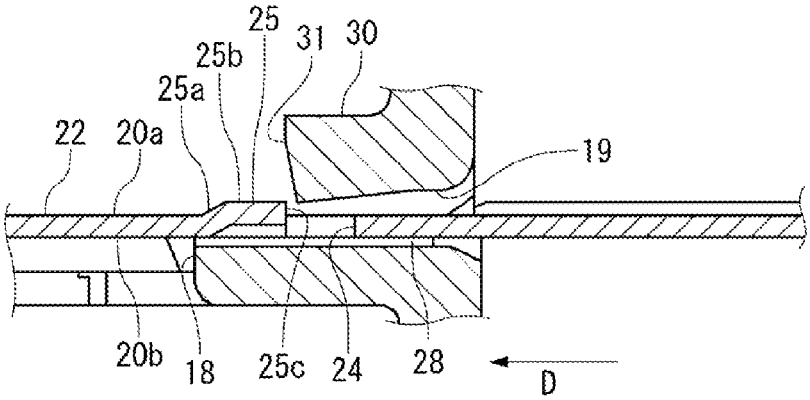
FIG. 4*c* is another sectional view of the terminal and the housing of FIG. 4*a*, showing the terminal secured with the housing.

Next, action of the lance 30 in the process of press-fitting the terminal 20 into the housing 11 will be explained with reference to FIGS. 4*a* through 4*c*. Incidentally, movement of the lance 30 explained below is a movement relative to the terminal 20.

As shown in FIG. 4(*a*), the terminal 20 is inserted into the terminal receiving passageway 19 of the housing 11 from its front side rearward, as shown by arrow D.

Since the lance 30 includes at a position higher than the top side 20*a*, the terminal 20 is inserted without contacting of the tine portion 22 (the top side 20*a*) with the lance 30 until the lock 25 reaches the lance 30, as shown in FIG. 4(*a*). In the process of the insertion, the lance 30 moves to a movement region A shown in FIG. 3(*a*). That is, the lance 30 moves on a trajectory spaced upward from the top side 20*a* (a lance passage side) of the second tine 22*b*.

When further insertion of the terminal 20 is performed after the lock 25 has reached the lance 30, as shown in FIG. 4(*b*), the lance 30 comes in contact with the inclined portion 25*a* and the flat portion 25*b* in this order and the lock 25 passes through the lance 30 while pushing up the lance 30.

When the terminal 20 is inserted to the predetermined position and the lock 25 passes through the lance 30, the lance 30 returns to the free state elastically, so that the locking side 25*c* of the lock 25 and the locking side 31 of the lance 30 face each other, as shown in FIG. 4(*c*). Thus, the terminal 20 is retained by the lance 30.

After the terminal 20 is inserted to the predetermined position and it is press-fitted into the housing 11, the first tine 22*a* and the second tine 22*b* are folded to the lower side and the upper side, respectively, so that they are connected to the first board and the second board.

As explained above, in the connector 10, the locking side 25*c* includes at the lock 25 projecting from the top side 20*a* of the terminal 20 (the second tine 22*b*) and the lance 30 includes at such a position that the lance 30 is spaced from the top side 20*a* of the terminal 20 while it interfaces with the lock 25.

Therefore, during the insertion process of the terminal 20, the lance 30 moves relative to the terminal 20 (the top side 20*a*) without coming in contact with the terminal 20 (the top side 20*a*) until the lock 25 reaches the lance 30, and thereafter the lance 30 comes in contact with the lock 25.

Therefore, according to the connector 10, since it can be avoided that the plating applied to the tine portion 22 is scraped by the lance 30, the solder wettability can be secured.

Further, even in a portion of the tine portion 22 which is not provided for soldering, a damage occurring upon scraping is not preferable from the view point of appearance, but the damage can be prevented from occurring according to the connector 10.

Incidentally, since the lock 25 is not soldered to the board and it is received inside the housing 11, even if it is scraped by the lance 30, the scraping is not problematic.

In addition, according to the connector 10, a width required to allow flowing of large current in the second tine 22*b* of the tine portion 22 can be secured. That is, in order to avoid contact between the lance 30 and the second tine 22*a*, the movement region A of the second tine 22*b* shown in FIG. 3(*a*) can be cut off. However, when the movement region A is cut off, the width of the second tine 22*b* becomes narrower correspondingly, so that a value of current which is allowed to flow is restricted. On the other hand, in the connector 10, since contact between the lance 30 and the second tine 22*a* is avoided, it is unnecessary to narrow the width of the second tine 22*b*, so that the width of the tine portion 22 (the first tine 22*a* and the second tine 22*b*) can be set corresponding to large current.

Further, since the terminal 20 is pressed against the supporting wall 18 using the press-fitting projections 28 and 28 generating limited pressure, the terminal 20 is secured in the housing 11 in a more stable state. Since the terminal 20 can be securely held in the housing 11, the terminal 20 is prevented from falling out by providing the lance 30 only on one side.

Incidentally, in the shown embodiment, the lance 30 is provided on the upper side. However, one skilled in the art should appreciate that it may be provided on the lower side. In this case, a similar effect can be achieved by using the terminal 20 in a reversed state.

In the embodiment shown in FIGS. 1-4*c*, the means for preventing the second tine 22*b* from being scraped by the lance 30 by causing the lock 25 to project from the top side 22*a* of the terminal 20 (the second tine 22*b*) has been explained.

The invention has the gist that a portion locking the lance 30 has been raised relative to the top side 20*a*. Though the this embodiment is configured such that the portion to be locked by the lance 30 is caused to project relative to the top side 20*a*, means for recessing the top side 20*a* relative to the locking portion will be explained in an embodiment shown in FIGS. 5*a*-5*c*.

Portions of this embodiment differ from those of first embodiment shown in FIGS. 1-4*c* will be mainly explained below. Incidentally, same reference signs are attached to same constituent portions as those of the embodiment in FIGS. 1-4*c* and explanation thereof is omitted.

Figure 5A:
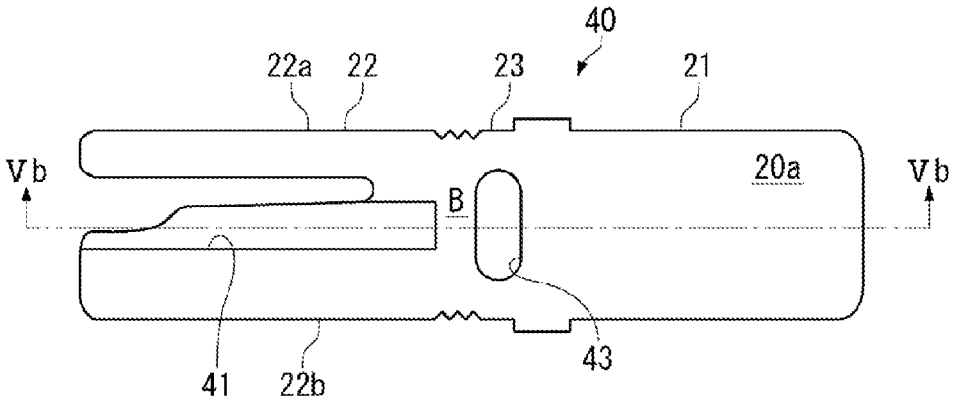
FIG. 5*a* is a plan view of another terminal of the electrical connector according to the invention.
Figure 5B:
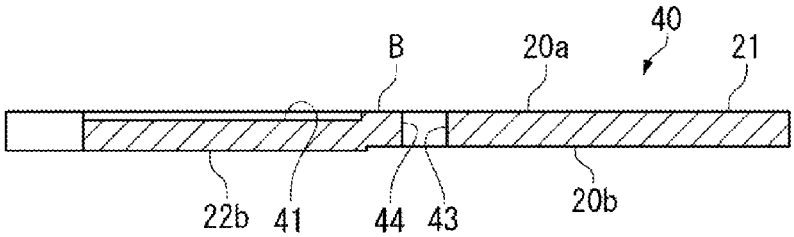
FIG. 5*b* is a section view of the terminal of FIG. 5*a* taken along line Vb-Vb.
Figure 5C:
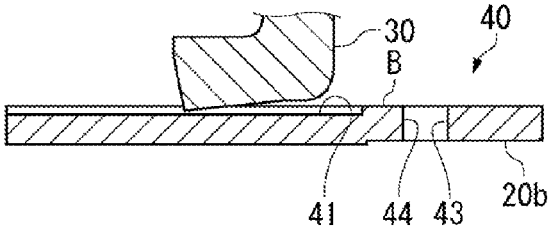
FIG. 5*c* is a sectional view of the terminal of FIG. 5*a*, showing insertion of the terminal into a housing thereof.

As shown in FIGS. 5*a*-5*c*, a terminal 40 according to another embodiment of the invention is formed with a groove 41 (a lance passage side) in a region corresponding to the trajectory of passage of the lance 30 upon inserting the terminal 40. The groove 41 is provided on the top side 20*a* of the second tine 22*b*, and a depth and a width thereof are set such that the lance 30 in a free state does not interfere with the terminal 40 upon inserting the terminal 40.

The shown embodiment is not provided with the lock 25 and it is configured such that the lance 30 is locked to a locking side 44 composed of an inner wall defining a locking hole 43 penetrating the top and bottom of the holding portion 23.

Incidentally, a forming method of the groove 41 is arbitrary, and the groove 41 can be formed by stamping process or cutting process. The terminal 40 shown in FIGS. 5*a*-5*c* is obtained by the stamping process, and the bottom side 20*b* of the second tine 22*b* pressed is caused to project downward relative to the other portion of the second tine 22*b*, as shown in FIG. 5(*b*) and FIG. 5(*c*).

In the process of press-fitting the terminal 40 into the housing 11, the lance 30 passes through the second tine 22*b* without coming in contact with the second tine 22*b* because the groove 41 is formed. Therefore, a movement trajectory of the lance 30 is formed at a position facing a bottom face of the groove 41.

Then, when the lance 30 reaches a region B of the top side 20*a* which is not formed with the groove 41, it rides on the region B, and when the lance 30 further moves, it drops in the locking hole 43 to be locked to the locking side 44.

It is unnecessary to change molding for the housing 11 especially because the above-described advantageous effect can be achieved by only forming the groove 41 in the terminal 40 without changing the position of the conventional lance 30.

Though the embodiments of the invention have been explained above, it is possible to select the constitutions described in the above-described embodiments or change these constitutions to other constitutions without departing from the gist of the invention.

What is claimed is:

1. An electrical connector, comprising:

a housing having a terminal receiving passageway and a lance extending into the terminal receiving passageway, the lance integrally formed with the housing and being elastically deflectable; and a terminal located in the terminal receiving passageway, the terminal including a connecting portion located along one end and a tine portion located at an opposite end thereof; and having a top surface facing the lance and a holding portion extending from and above the top surface; the holding portion including a receiving passageway penetrating a top and bottom thereof and a lock extending toward the receiving passageway and the connecting portion.

2. The electrical connector according to claim 1, wherein the holding portion connects the connecting portion and the tine portion with each other.

3. The electrical connector according to claim 1, wherein the terminal is integrally formed by stamping an elastic material.

4. The electrical connector according to claim 1, wherein the receiving passageway and the lock are arranged along a central portion of the holding portion with respect to a width of the terminal.

5. The electrical connector according to claim 4, wherein the lock includes an inclined portion rising up from the top surface.

6. The electrical connector according to claim 5, wherein the lock further includes a flat portion that communicates with the inclined portion and is positioned parallel to the top surface.

7. The electrical connector according to claim 6, wherein the lock further includes a locking side positioned along a front end of the flat portion and is positioned perpendicular to the top surface.

8. The electrical connector according to claim 7, further comprising a pair of press-fitting projections positioned on opposite sides of the holding portion along a width thereof.

9. The electrical connector according to claim 8, wherein the press-fitting projections project from a bottom surface of the terminal.

10. The electrical connector according to claim 9, further comprising a pair of tabs projecting from opposite edges of the holding portion along a width thereof.

11. The electrical connector according to claim 1, wherein the tine portion is bifurcated and includes a first tine and a second tine each folded and extending in opposite directions.

12. The electrical connector according to claim 1, further comprising a pair of press-fitting projections positioned on opposite sides of the holding portion along a width thereof.

13. The electrical connector according to claim 12, wherein the press-fitting projections project from a bottom surface of the terminal.

14. The electrical connector according to claim 1, wherein the lance is a cantilever member extending to a rear end thereof.

15. The electrical connector according to claim 14, wherein the lance is inclined toward the terminal receiving passageway.

* * * * *